US005873401A

United States Patent [19]

Tsuchida

[11] Patent Number: 5,873,401

[45] Date of Patent: Feb. 23, 1999

[54] SCREEN APPARATUS

[75] Inventor: Osamu Tsuchida, Kanagawa, Japan

[73] Assignee: Metaco, Inc., Tokyo, Japan

[21] Appl. No.: 679,449

[22] Filed: Jul. 12, 1996

[30] Foreign Application Priority Data

Jul. 14, 1995 [JP] Japan ..... 7-178451
Jul. 11, 1996 [JP] Japan ..... 8-181926

[51] Int. Cl.[6] ..... A47H 5/00

[52] U.S. Cl. ..... 160/84.04; 160/84.01; 160/84.06; 160/279

[58] Field of Search ..... 160/84.04, 84.01, 160/84.06, 314, 279

[56] References Cited

U.S. PATENT DOCUMENTS

| | | | |
|---|---|---|---|
| 1,567,095 | 12/1925 | Anderson | 160/314 |
| 4,762,159 | 8/1988 | Ford | 160/279 X |
| 5,179,989 | 1/1993 | Schon | 160/279 X |
| 5,253,914 | 10/1993 | Biancale | 160/84.06 X |
| 5,365,991 | 11/1994 | Wright et al. | 160/84.04 |
| 5,451,445 | 9/1995 | Wang | 160/84.04 X |
| 5,456,303 | 10/1995 | Horinouchi | 160/84.04 |
| 5,477,904 | 12/1995 | Yang | 160/84.06 X |
| 5,542,460 | 8/1996 | McKeon | 160/84.01 X |

*Primary Examiner*—Daniel P. Stodola
*Assistant Examiner*—Bruce A. Lev
*Attorney, Agent, or Firm*—Wenderoth, Lind & Ponack, L.L.P.

[57] ABSTRACT

A screen apparatus which has a pair of opposed frame portions provided on the top and bottom sides and a pair of opposed frame portions provided on the right and left sides. One pair serves as screen fitting frame portions, fitting and supporting a screen member in between, contractibly and expandable. The other pair of opposed frame portions forms sliding guide frame portions. The pair of sliding guide frame portions are flexible. The sliding guide frame portions have one end secured to one of the screen fitting frame portions and the other end is bent and slides along the other screen fitting frame portion as the screen member is contracted or expanded to maintain a prescribed distance between the pair of opposed screen fitting frame portions.

15 Claims, 13 Drawing Sheets

PRIOR ART

PRIOR ART

SCREEN APPARATUS

FIELD OF THE INVENTION

The present invention relates to a screen apparatus. More particularly, the present invention relates to a novel screen apparatus which is useful for opening and closing an window opening, for uses as a partition or a netted door, or as an outdoor installation. In addition, the apparatus is versatile, is easy to operate, and has an attractive appearance.

PRIOR ART

Screen apparatuses of various configurations have conventionally been employed as opening/closing apparatuses of window openings and partitions in houses and office buildings. Known typical apparatuses include curtains, blinds, movable partitions and single-leaf screens.

While these apparatuses are installed with various materials and various structures, depending upon the proposed purpose of application and use, a requirement common to all the conventional opening/closing apparatuses has been the presence of top, bottom, right and left fixed frame portions. The existence of these fixed frame portions has naturally restricted design and installation of the screen apparatuses.

These restrictions, while not being so marked as to hinder the installation of the screen apparatus at the opening of a window or a wall, posed serious problems in appearance, design, installation and operation when using it as a partition or a single-leaf screen.

For example, when building a screen apparatus with a foldable/unfoldable screen member (1) as shown in FIG. 13, components essential for permitting folding and unfolding by opening/closing of the screen member (1) include a movable frame portion (2) supporting the fitted screen member (1), a first fixed frame (3) similarly supporting the fitted screen member (1), a second fixed frame (4) opposed thereto, a third upper fixed frame (5) and a fourth lower frame (6) for fixing the first and second fixed frames (3) and (4).

When using the apparatus shown in FIG. 13 as a partition, the screen member (1) can be opened and closed, whereas the four fixed frames (3), (4), (5) and (6) are eyesores and may hinder the movement of people and the installation of furniture.

When arranging a wire member (7) or a rod to support the screen member (1), as shown in FIG. 14, these problems become more pronounced.

Thus, for conventional screen apparatuses, the restrictions resulting from the presence of fixed frame portions have been left unsolved, irrespective of whether the use is as a window opening/closing apparatus or as a partition.

SUMMARY OF THE INVENTION

Therefore an object of the present invention is to provide a novel screen apparatus which solves the drawbacks of the conventional screen apparatuses as described above. Specifically, the present invention largely improves restrictions in design and installation resulting from the presence of fixed frame portions, is easy to install and operate, and is attractive.

To solve the above-mentioned problems, the present invention provides a screen apparatus which has a pair of opposed frame portions provided on the top and bottom sides and a pair of opposed frame portions provided on the right and left sides. One pair of the opposed frame portions, serves as screen fitting frame portions, fitting and supporting a screen member in between, contractibly and expandably. The other pair of opposed frame portions forms sliding guide frame portions. Any or each of the screen fitting frame portions is movable in the contracting and expanding direction of the screen member. The pair of sliding guide frame portions are flexible. Each of the sliding guide frame portions has an end secured to one of the screen fitting frame portions. The other end of the sliding guide frame portion is bent and inserted into a hollow portion of the opposite screen fitting frame portion. In use, the bent end of the sliding guide frame portion slides along the screen fitting frame portion as the screen member contracts or expands to maintain a prescribed distance between the pair of opposed screen fitting frame portions.

DETAILED DESCRIPTION OF THE INVENTION

Figure 1:
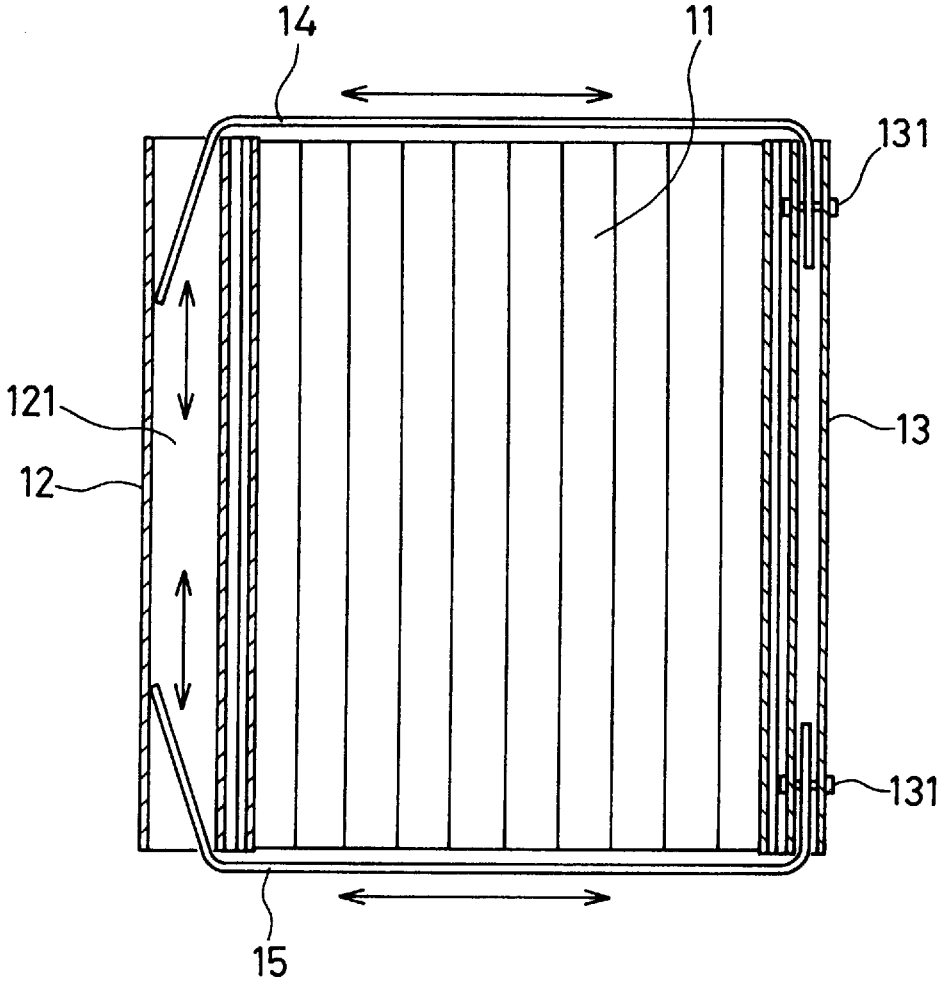
FIG. 1 is a front view of an embodiment of a screen apparatus of the present invention.

FIG. 1 is a sectional view illustrating the basic construction of the screen apparatus of the present invention.

As shown in FIG. 1, for example, the screen apparatus of the invention has two opposed frame portions on the top and bottom sides and two opposed frame portions on the right and left sides. The respective frame portions form a pair of screen fitting frame portions (12) and (13) which fit and support a foldable/unfoldable screen member (11), and a pair of sliding guide frame portions (14) and (15).

Of the screen fitting frame portions (12) and (13), one, for example, the screen fitting frame portion (12) is secured to a wall surface, a window opening end, or a post, and the other screen fitting frame portion (13) is movable, or vice versa. Or, both portions may be movable, and the screen member (11) may be folded to contract and unfold to expand by provisionally fixing one of the screen fitting frame portions and moving the other.

Each of the sliding guide frame portions (14) and (15) is flexible. In the embodiment shown in FIG. 1, for example, an end of each sliding guide frame portion is secured to a fixing portion (131) of one screen fitting frame portion (13). The other end slides along the other screen fitting frame portion (12) while the screen member (11) folds or unfolds as it is contracted or expanded. More specifically, upon folding and contraction of the screen member (11), the sliding guide frame portions are bent and inserted into a hollow portion (121) of the screen fitting frame portion (12). When the acting force for folding and contracting the screen member (11) ceases, the sliding guide frame portions (14) and (15) discontinue sliding. As a result of this discontinuance, the distance between the screen fitting frame portions (12) and (13) is kept constant at a prescribed value.

Figure 2:
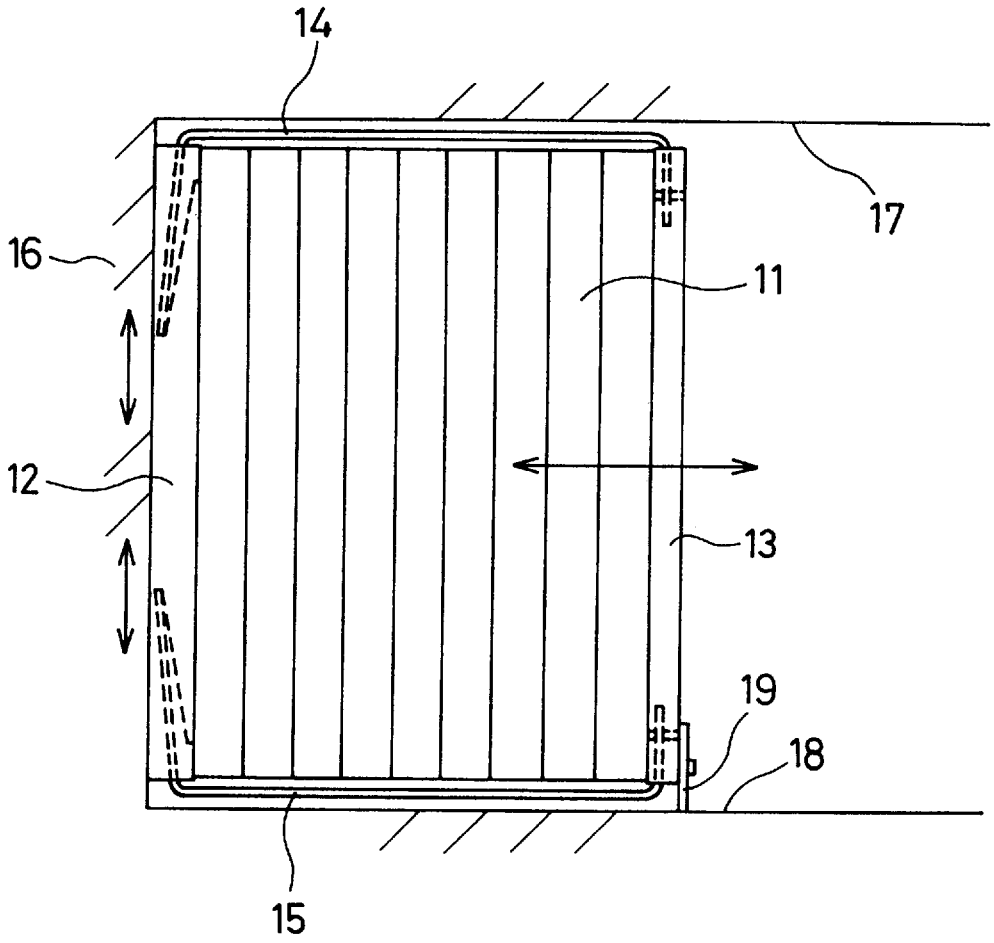
FIG. 2 is a front view of another embodiment of the apparatus of the present invention.
Figure 3:
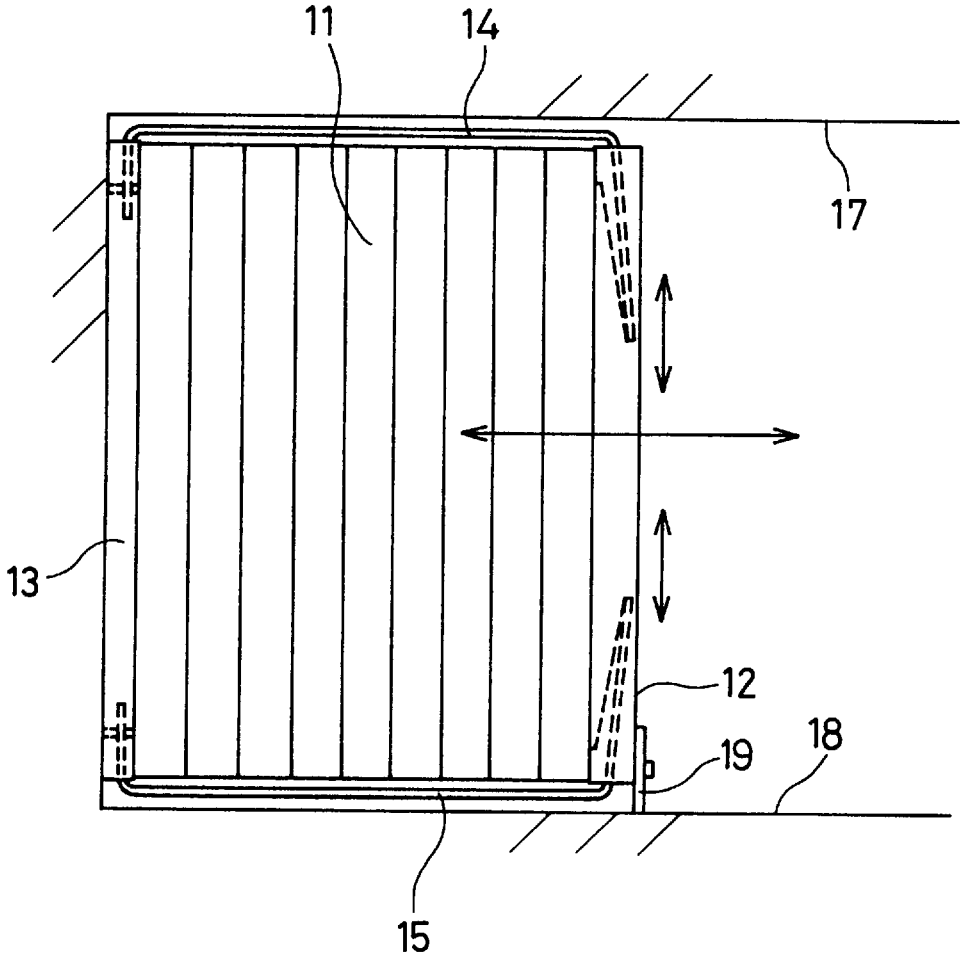
FIG. 3 is a front view of yet another embodiment of the present invention.

FIGS. 2 and 3 illustrate an embodiment in which one of the screen fitting frame portions (12) and (13) is secured to a wall surface opening end (16) as a fixed frame portion, and the other serves as a movable frame portion, thus forming a partition between a ceiling surface (17) and a floor surface (18). As is clear from FIGS. 2 and 3, the screen apparatus of the present invention does not require four fixed frame portions on its four peripheral sides as in the conventional cases, but requires only one fixed frame portion.

As shown in FIGS. 2 and 3, a stopper (19) for fixing the stop state at a prescribed position may be provided in the movable frame portion so as to fix the screen by bringing the screen into contact with the floor surface (18) or the ceiling surface (17). It is needless to mention that this stopper is not always necessary. The screen apparatus may be installed at a window opening.

Figure 4:
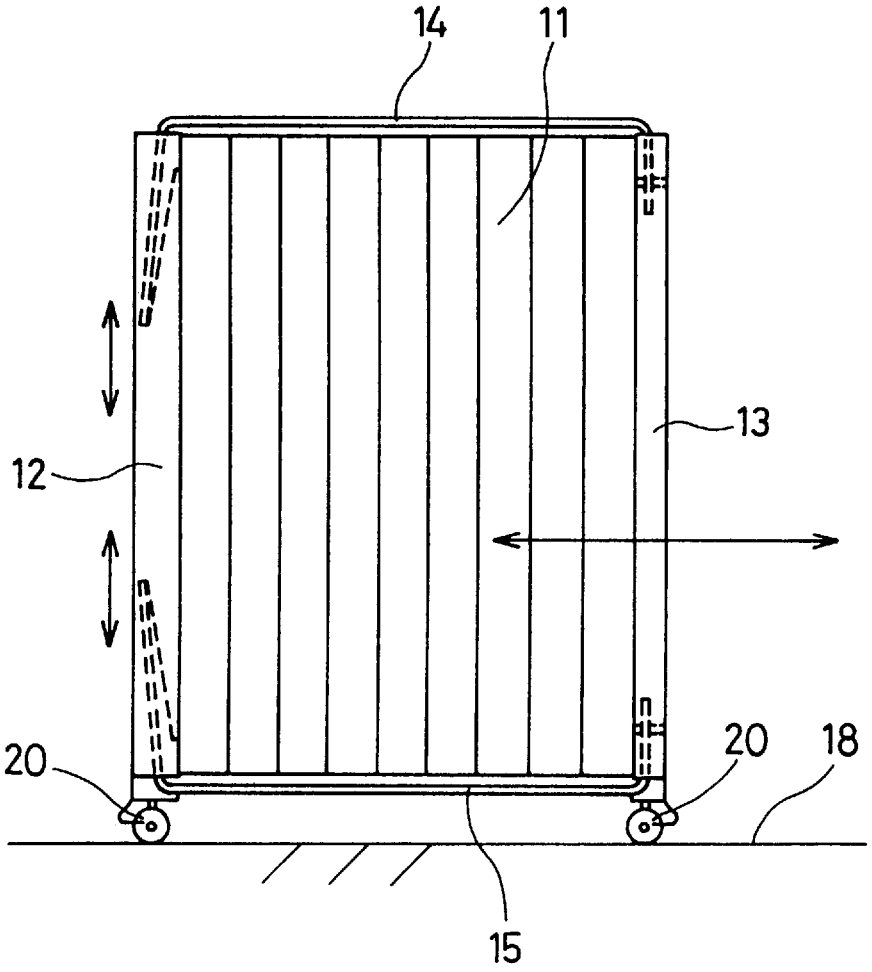
FIG. 4 is a front view of an embodiment having casters.

As shown in FIG. 4, casters (20) having stoppers may be attached to the bottoms of the screen fitting frame portions (12) and (13) to form a movable partition or the like. With this arrangement, a partition having a required screen area may be formed by securing the casters (20) of the screen fitting frame portion (12). Next, the screen fitting frame portion (13) is treated as the movable frame portion, and folded to contract or unfolded to expand the screen member (11). The screen fitting frame portion (12) may of course be used as the movable frame portion. In the present embodiment, as is clear, the screen apparatus has no fixed frame portions on the four peripheral sides as in the conventional cases, thus the screen is versatile and attractive.

Figure 5:
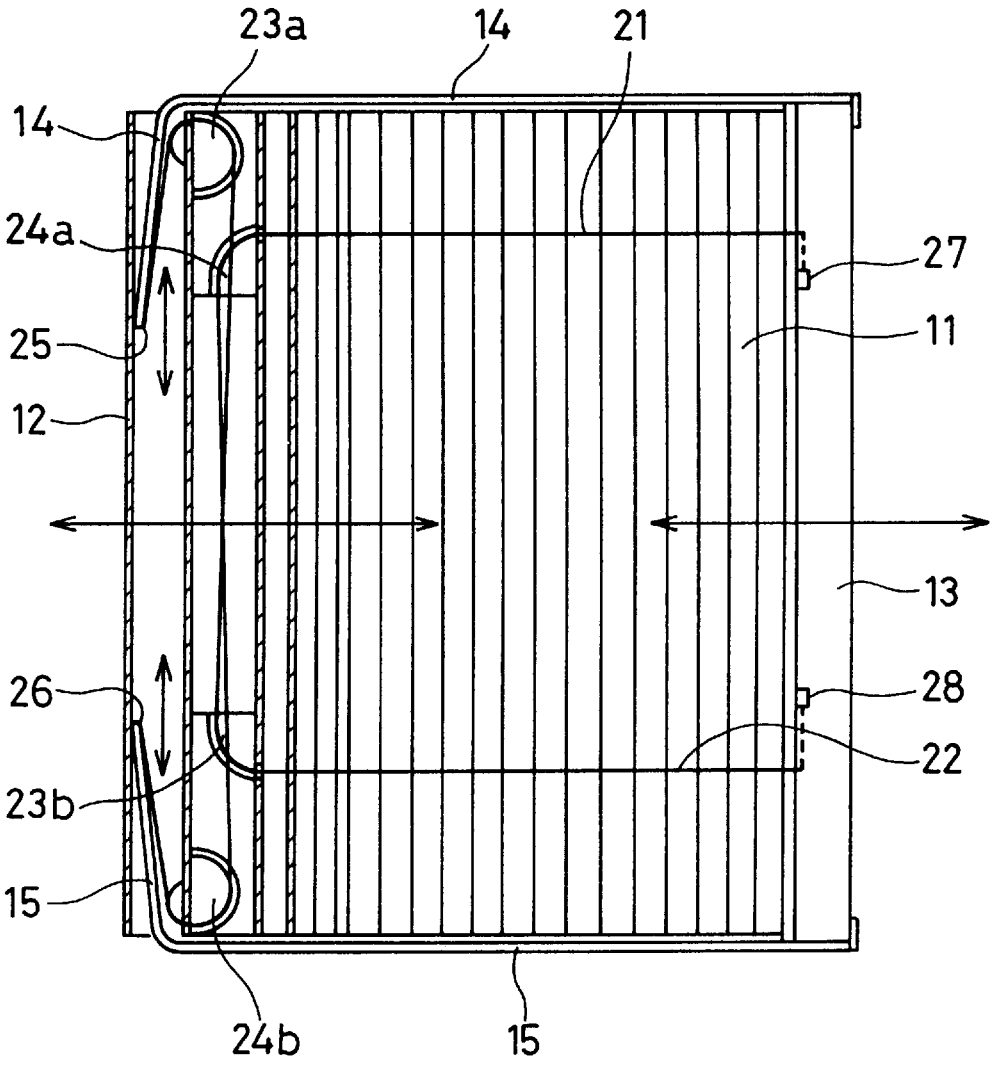
FIG. 5 is a sectional view of an embodiment in which a wire member is stretched.

In the present invention, furthermore, a wire member may be used with the screen member (11). As shown in FIG. 5, for example, a pair of opposed screen fitting frame portions (12) and (13) are provided on the right and left sides and a pair of opposed sliding guide frame portions (14) and (15) are provided on the top and bottom sides. A pleated screen member (11) having a plurality of pleats is fitted and supported foldably and unfoldably in the opening/closing direction on the screen fitting frame portions (12) and (13). Wire members (21) and (22) supporting this pleated screen member (11) are stretched in the opening/closing direction.

The pair of screen fitting frame portions (12) and (13) support the pleated screen member (11). Turning devices **(23*a*) and (23*b*) and wire member turning devices (24*a*) and (24*b*) are located within the screen fitting frame portion (12)**.

A pair of upper and lower sliding guide frame portions (14) and (15) not supporting the pleated screen member (11) are secured, on the other hand, to the screen fitting frame portion (13).

As is clear from FIG. 5, the upper and lower sliding guide frame portions (14) and (15) have one end secured to the screen fitting frame portion (13). The other end bends and slides along the other screen fitting frame portion (12) as the pleated screen member (11) is folded and unfolded, and thus keeps a prescribed distance between the screen fitting frame portions (12) and (13).

In this embodiment, the above-mentioned wire members (21) and (22) are stretched past the bent ends of the sliding guide frame portions (14) and (15) and between the individual fixing points (26), (26), (27) and (28) to which the ends of the wire members are fixed. The wire members also extend through turning means **(23*a*), (23*b*), (24*a*) and (24*b*) of the screen fitting frame portion (12). In addition, the wires support the pleated screen member (11) in the opening/closing direction between the screen fitting frame portions (12) and (13)**.

In this structure, the screen fitting frame portions (12) and (13) are slidable independently. In actual operation, however, one of them is fixed, and the other is movable.

In this embodiment, the bent sliding guide frame portions (14) and (15) should have a strength sufficient to resist buckling caused by the tension of the wire members (21) and (22). It is needless to mention that supporting of the pleated screen member (11) by the wire members is not limited to the manner shown in FIG. 5.

Figure 6:
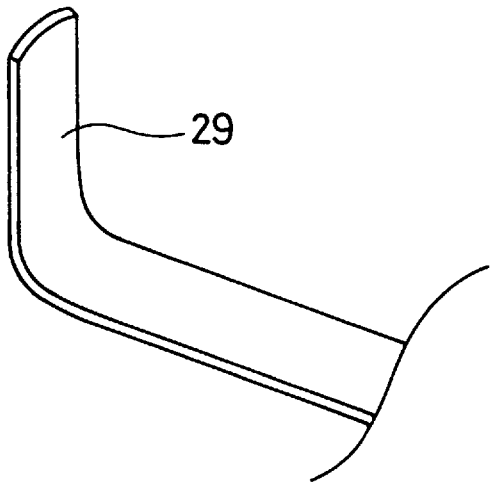
FIG. 6 is a perspective view of a bent sliding guide frame portion.
Figure 7:
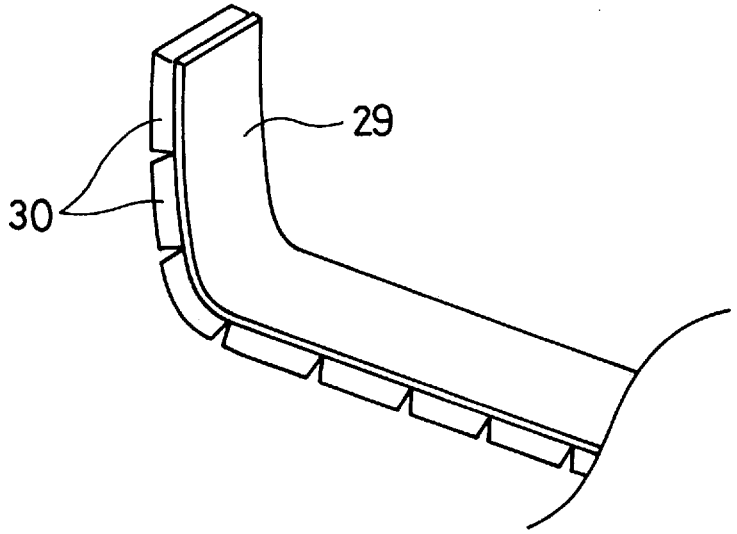
FIG. 7 is a perspective view of another bent sliding guide frame portion.
Figure 8:
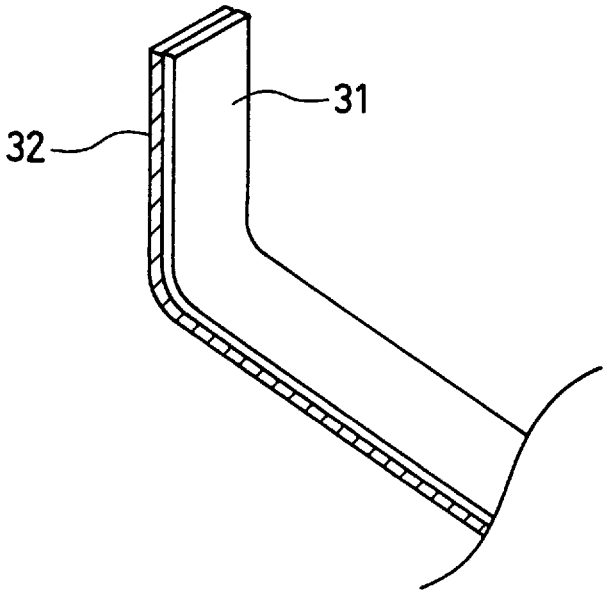
FIG. 8 is a perspective view of yet another bent sliding guide frame portion.

The sliding guide frame portions (14) and (15) in the screen apparatus of the above-mentioned embodiment may take the form of a strip-shaped spring member (29) commonly known as "Convex" shown in FIG. 6, a combination of a strip-shaped spring member (29) and connected blocks (30) of plastics or the like shown in FIG. 7, a combination of strip-shaped members (31) and (32) having different values of modules of flexural elasticity as shown in FIG. 8, a fiber-reinforced plastic strip member, or any other member that is flexible.

Figure 9:
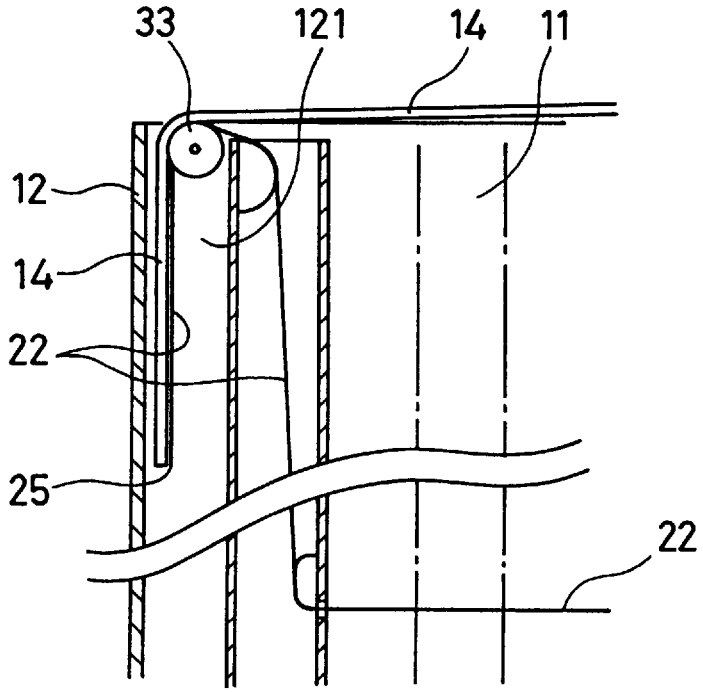
FIG. 9 is a sectional view of an arrangement of a bent sliding guide frame portion and a wire member.

FIG. 9 illustrates an embodiment of the arrangement of the sliding guide frame portions and the wire members. A turning device (33) for inserting the sliding guide frame portion (14) and the wire member (22) into a hollow portion (121) of the screen fitting frame portion (12) is provided.

Figure 10:
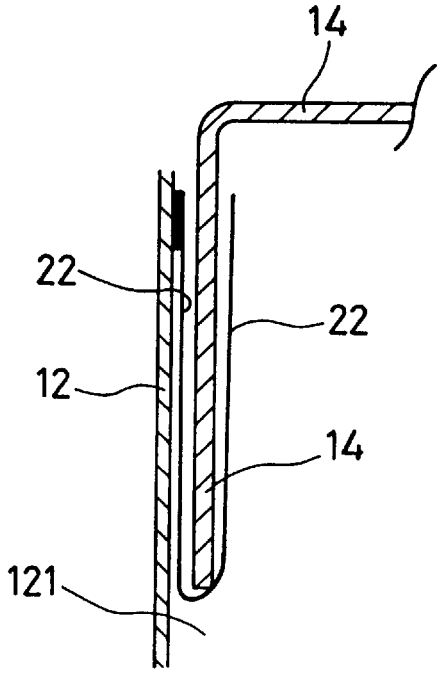
FIG. 10 is a sectional view of another arrangement of a bent sliding guide frame portion and a wire member.

The structure is not of course limitative. As shown in FIG. 10, for example, an end of the wire member (22) may be fixed to the hollow portion (121) of the screen fitting frame portion (12) so as to draw out the wire member (22) slidably through the bent portion of the sliding guide frame portion (14). In this case, a larger sliding of the wire member (22) is possible even if the bent portion of the sliding guide frame portion (14) is shorter.

In the present invention, the screen member may be cloth, a sheet, a net, connected sheets, or a composite member of any of these members, and the shape of the screen member may be a pleated shape having a plurality of pleats, or any other shape.

In the above-mentioned embodiment, the pleated screen member (11) is foldable to contract and unfoldable to expand. Furthermore, the screen member may be contracted by winding by means of a roller winder. In this case, as in the case of a roll screen, the roller winder may be provided with a spring mechanism to which rotation resulting from drawout and expansion of the screen member imparts a rotational restituting force in a winding/contracting direction. This roller winder may be arranged at the screen fitting frame portion.

In the present invention, furthermore, the following embodiments are provided.

Figure 11:
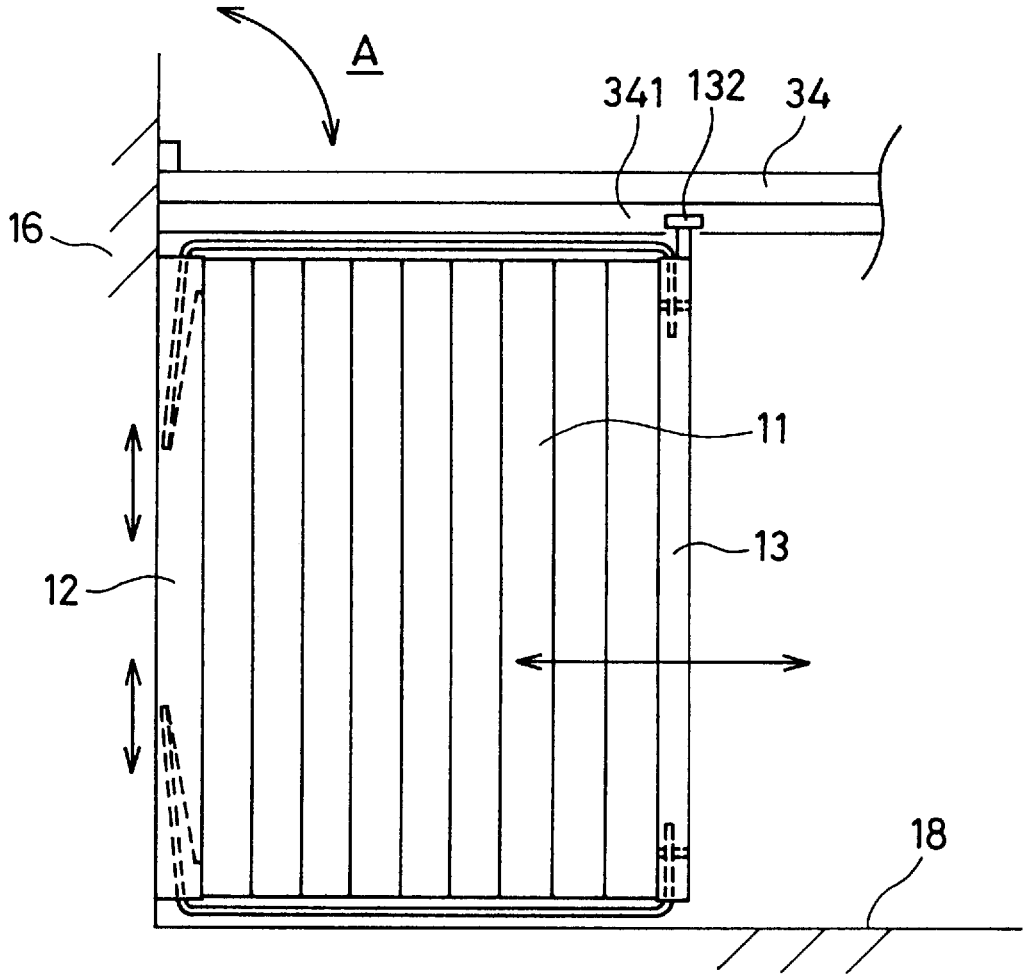
FIG. 11 is a front view of still another embodiment of the present invention.

For example, as shown in FIG. 11, a sliding engagement portion (132) may be provided at the top of the screen fitting frame portion (13). Stable sliding of the screen member (11) and the screen fitting frame portion (13) may be ensured by arranging a fixed frame (34) above the screen member, and engaging the sliding engagement portion (132) within a groove (341) located in the fixed frame. In this case, the fixed frame (34) may be housed and installable in the (A) direction in FIG. 11.

Figure 12:
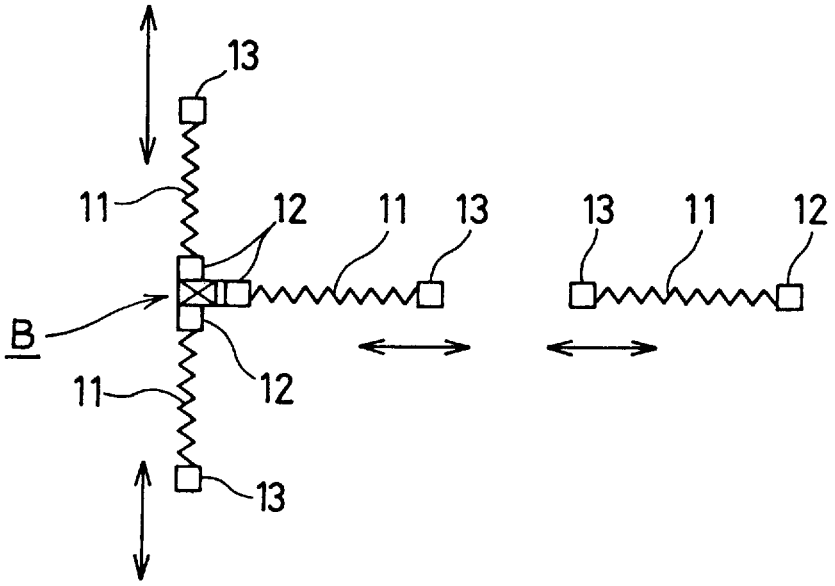
FIG. 12 is a front view of a configuration having a plurality of units.
Figure 13:
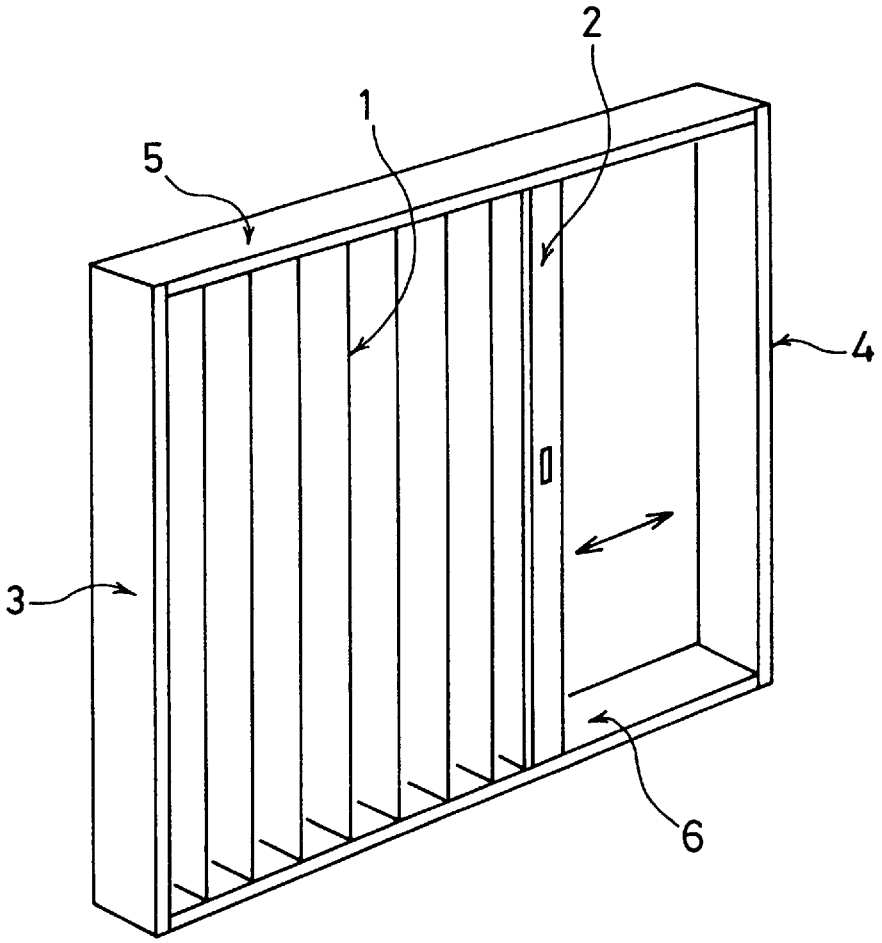
FIG. 13 is a perspective view of a prior art screen apparatus.
Figure 14:
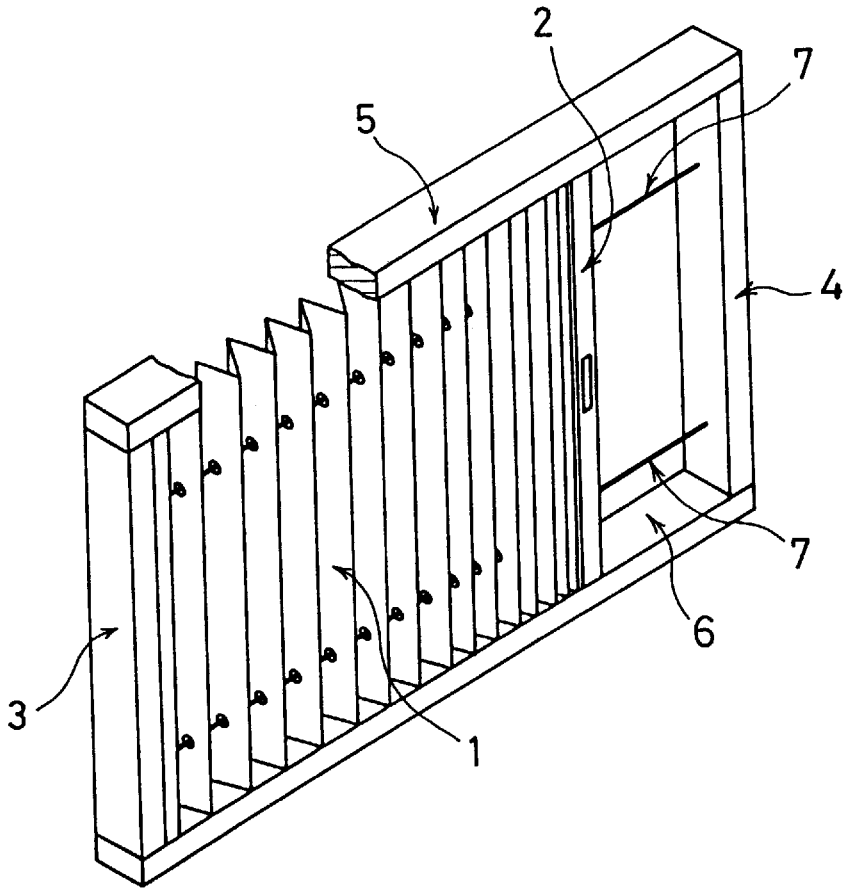
FIG. 14 is a perspective view of another prior art screen apparatus.

In the present invention, as shown in the plan view of FIG. 12, a plurality of screen apparatuses (11) in the form of units may be arranged in tandem around a prescribed fixing point (B).

According to the present invention, as described above in detail, there is provided a novel screen apparatus which solves the drawbacks in the conventional screen apparatuses resulting front the presence of fixed frame portions, and has a high degree of versatility and is easier to install and operate.

The screen apparatus of the invention can be installed as a window opening/closing apparatus, a partition, a netted door and various other indoor and outdoor devices.

It is claimed:

1. An openable and closable screen apparatus, comprising:

a screen have a top side, a bottom side, a first side and a second side;

a first screen fitting frame portion attached to said first side of said screen;

a second screen fitting frame portion attached to said second side of said screen;

a first sliding guide frame portion comprised of a first flexible strip which is bendable and which has an elastic returning force, said first sliding guide frame portion having an end which is attached to said second screen fitting frame portion, a portion bounding said top side of said screen, and a free end which slidingly abuts said first screen fitting frame portion;

a second sliding guide frame portion comprised of a second flexible strip which is bendable and which has an elastic returning force, said second sliding guide frame portion having an end which is attached to said second screen fitting frame portion, a portion bounding said bottom side of said screen, and a free end which slidingly abuts said first screen fitting frame portion;

wherein the length of said portion bounding said top side of said screen and said portion bounding said bottom side of said screen decreases as said first screen fitting frame portion is moved toward said second screen fitting frame portion; and wherein the length of said portion bounding said top side of said screen and said portion bounding said bottom side of said screen increases as said first screen fitting frame portion is moved away from said second screen fitting frame portion.

2. An openable and closable screen apparatus as in claim 1, wherein:

one of said first screen fitting frame portion and said second screen fitting frame portion is adapted to be movable relative to the other of said first screen fitting frame portion and said second screen fitting frame portion; and the other of said first screen fitting frame portion and said second screen fitting frame portion is adapted to be stationary.

3. An openable and closable screen apparatus as in claim 1, wherein:

said first screen fitting frame portion has a hollow portion formed therein; and said free end of said first sliding guide frame portion and said free end of said second sliding guide frame portion extend into said hollow portion.

4. An openable and closable screen apparatus as in claim 1, wherein:

each of said first sliding guide frame portion and said second sliding guide frame portion further comprise a plurality of plastic blocks mounted on said flexible strips.

5. An openable and closable screen apparatus as in claim 1, wherein:

said first flexible strip of said first sliding guide frame portion further comprises at least one additional flexible strip mounted thereon;

said second flexible strip of said second sliding guide frame portion further comprises at least one additional flexible strip mounted thereon; and said first flexible strip and said second flexible strip have a modulus of elasticity which is not equal to a modulus of elasticity of said additional flexible strips.

6. An openable and closable screen apparatus as in claim 1, wherein:

each of said first sliding guide frame portion and said second sliding guide frame portion is reinforced with fiber.

7. An openable and closable screen apparatus as in claim 1, wherein:

said screen comprises a cloth.

8. An openable and closable screen apparatus as in claim 1, wherein:

said screen comprises a sheet.

9. An openable and closable screen apparatus as in claim 1, wherein:

said screen comprises a net.

10. An openable and closable screen apparatus as in claim 1, wherein:

said screen further comprises a plurality of pleats such that said screen is able to fold and contract.

11. An openable and closable screen apparatus as in claim 1, further comprising:

at least one wire, to support said screen, having a first end attached to one free end of said first and second sliding guide frame portions and a second end attached to said second screen fitting frame portion.

12. A screen system, comprising:

at least one screen apparatus; and a fixed member;

wherein each of said at least one screen apparatus comprises:

a screen have a top side, a bottom side, a first side and a second side;

a first screen fitting frame portion attached to said first side of said screen;

a second screen fitting frame portion attached to said second side of said screen;

a first sliding guide frame portion comprised of a first flexible strip which is bendable and which has an elastic returning force, said first sliding guide frame portion having an end which is attached to said second screen fitting frame portion, a portion bounding said top side of said screen, and a free end which slidingly abuts said first screen fitting frame portion;

a second sliding guide frame portion comprised of a second flexible strip which is bendable and which has an elastic returning force, said second sliding guide frame portion having an end which is attached to said second screen fitting frame portion, a portion bounding said bottom side of said screen, and a free end which slidingly abuts said first screen fitting frame portion;

wherein the length of said portion bounding said top side of said screen and said portion bounding said bottom side of said screen decreases as said first screen fitting frame portion is moved toward said second screen fitting frame portion; and wherein the length of said portion bounding said top side of said screen and said portion bounding said bottom side of said screen increases as said first screen fitting frame portion is moved away from said second screen fitting frame portion;

wherein one of said first screen fitting frame portion and said second screen fitting frame portion of said at least one screen apparatus is fixed to said fixed member.

13. The screen system of claim 12, wherein:

said at least one screen apparatus is two screens.

14. The screen system of claim 12, wherein:

said at least one screen apparatus is three screens.

15. The screen system of claim 12, wherein:

said at least one screen apparatus is four screens.

* * * * *